US006564515B1

(12) United States Patent
Fontenot et al.

(10) Patent No.: US 6,564,515 B1
(45) Date of Patent: May 20, 2003

(54) LAND ANCHOR

(76) Inventors: Steven F. Fontenot, 14106 Ventress Roads, Ventress, LA (US) 70788; Patrick J. Connolly, 10113 Hillyard Ave., Baton Rouge, LA (US) 70809

( * ) Notice: Subject to any disclaimer, the term of this patent is extended or adjusted under 35 U.S.C. 154(b) by 0 days.

(21) Appl. No.: 10/050,566

(22) Filed: Jan. 15, 2002

(51) Int. Cl.[7] ..... E02D 5/80; B63B 21/40
(52) U.S. Cl. ..... 52/155; 114/294; 114/304
(58) Field of Search ..... 114/294, 301, 114/303, 304; 52/155, 162, 164, 166

(56) References Cited

U.S. PATENT DOCUMENTS 3,425,174 A * 2/1969 Wood
3,961,451 A * 6/1976 McCain ..... 114/301
5,437,128 A * 8/1995 Gremillion ..... 52/155

* cited by examiner

*Primary Examiner*—Sherman Basinger
(74) *Attorney, Agent, or Firm*—Roy, Kiesel, Keegan & DeNicola

(57) ABSTRACT

A land anchor for use with a winch and cable assembly affixed to a vehicle to pull the vehicle when immobilized having a fluke formed by wings shaped to penetrate into the ground and shaped to keep the fluke level during penetration into the ground, and a removable stock assembly attachable to the fluke. The fluke is provided with a stock assembly mount having a tubular member provided with a parallel slot extending through one side of the tubular member. The tubular member is fixedly attached to the rear thrust end section of the fluke with the slot being positioned to permit the stock assembly to be received by the stock assembly mount. The stock assembly has an engaging member shaped to engage and fix the stock assembly to the stock assembly mount. The stock assembly has an elongated bar fixed at one end to the engaging member and with its opposite end extending upward at an angle from the top surface, an elongated tubular member having a bar attaching end and a cable attaching end, the bar attaching end being pivotally attached to the opposite end of the bar, and an extender pivotally attached at one end to the bar and pivotally attached at its opposite end to the tubular member to permit the bar and the tubular member to fold toward one another for compact storage.

69 Claims, 3 Drawing Sheets

LAND ANCHOR

BACKGROUND OF THE INVENTION

1. Field of the Invention

This invention relates in general to land anchors used to pull a vehicle that has lost traction in mud or snow to ground where the vehicle can regain traction.

2. Prior Art

The use of various type land anchors to help pull a vehicle that has lost traction to an area where it can gain traction and move on its own power is well known. The most general use of such land anchors is in conjunction with a winch and cable assembly that is affixed to the vehicle. All such land anchors comprise two basic parts. The first is stake or fluke that is used to penetrate into the ground. The second is the stock that is used to set the pulling angle of the winch cable. U.S. Pat. Nos. 3,216,159 and 3,500,598 are examples of earlier land anchor construction that involved driving a stake member into the ground with a sledge hammer or similar tool. The principal draw back to such devices was the need to carry a sledgehammer to drive the stake into the ground. Such devices were often difficult to remove from the ground once they had been used. Additionally, they did not provide sufficient anchoring to be used to pull larger vehicles. To overcome some these draw backs the stake was replaced with various designed flukes. Examples of some these designs are illustrated in U.S. Pat. Nos. 3,828,497; 4,363,198; and 5,850,715. In addition several of these improved designs contained modifications to assist the land anchor in being fixed in the ground by winch and cable assembly. Although these designs did achieve this function they were very bulky and took up an undesired amount of storage space in the vehicle. Other designs, such as illustrated in U.S. Pat. No. 4,825,604, attempted to solve this problem by a construction that allowed the stock to be folded next the fluke when the land anchor is not in use.

Despite the improvements made to the earlier land anchors there still exists the need for a land anchor that can be positioned, anchored and operated by a single person, that can easily be driven into the ground by the winch and cable assembly attached to the vehicle, that is constructed to withstand the large forces necessary to pull large vehicles that have become immobilized in mud or snow, that can be easily removed from the ground once the vehicle has been pulled to free, and that is compact to require little cargo space when it is being stored in the vehicle.

OBJECTS AND SUMMARY OF THE INVENTION

Therefore, one object of this invention is to provide an improved land anchor that can be positioned, anchored, and operated to move a vehicle to a desired area by a single person.

Another object of this invention is to provide an improved land anchor that can easily be driven into the ground by the winch and cable assembly attached to the vehicle without the need to use a sledgehammer to drive the anchor fluke into the ground.

Another object of this invention is to provide an improved land anchor that is constructed to withstand the large forces necessary to pull large vehicles that have become immobilized in mud or snow.

Still another object of this invention is to provide an improved land anchor that can be easily removed from the ground once the vehicle has been pulled to free.

Still another object of this invention is to provide an improved land anchor that is compact when it is being stored in the vehicle.

Other objects and advantages of this invention shall become apparent from the ensuing descriptions of the invention.

Accordingly, a land anchor for use with a winch and cable assembly affixed to a vehicle to pull the vehicle when immobilized comprising a fluke having wings shaped to penetrate into ground and shaped to keep said fluke level during penetration into the ground, and a removable stock assembly affixable to said fluke. In a more preferred embodiment the fluke is provided with a stock assembly mount having a tubular member provided with a parallel slot extending through one side of the tubular member. The tubular member is fixedly attached to the rear thrust end section of the fluke with the slot being positioned to permit the stock assembly to be received by the stock assembly mount. The stock assembly has a engaging member shaped to engage and fix the stock assembly to the stock assembly mount. The stock assembly has an elongated bar fixed at one end to the engaging member. The opposite end of the elongated bar extends upward at an angle from the top surface. The stock assembly also has an elongated tubular member having a bar attaching end and a cable attaching end. The bar attaching end is pivotally attached to the opposite end of the bar. The stock assembly is also provided with an extension means pivotally attached at one end to the bar and pivotally attached at its opposite end to the tubular member to permit the bar and the tubular member to fold toward one another for compact storage.

BRIEF DESCRIPTION OF THE DRAWINGS

The accompanying drawings illustrate preferred embodiments of this invention. However, it is to be understood that these embodiment are not intended to be exhaustive, nor limiting of the invention. They are but examples of some of the forms in which the invention may be practiced.

PREFERRED EMBODIMENTS OF THE INVENTION

Without any intent to limit the scope of this invention, reference is made to the figures in describing the preferred embodiments of the invention. As illustrated in FIGS. 1–8 a preferred embodiment of a land anchor 1 is disclosed that achieves each of the specific objectives set forth above, as well as other objectives that will become apparent from the ensuing description of the invention.

Figure 1:
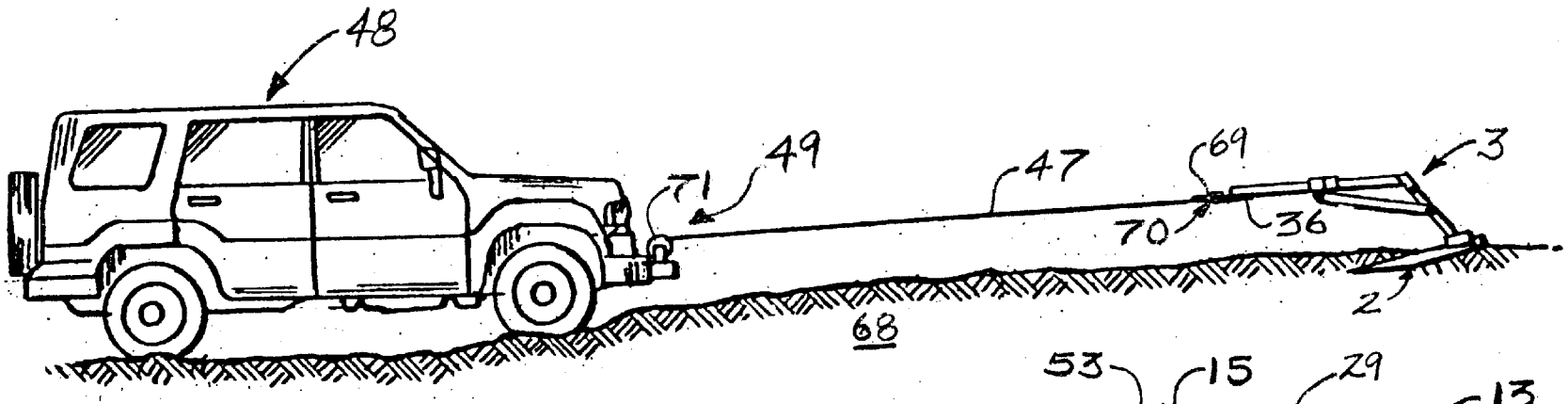
FIG. 1 is an elevational view of a preferred embodiment of the land anchor in position to move a vehicle to a desired location.
Figure 5:
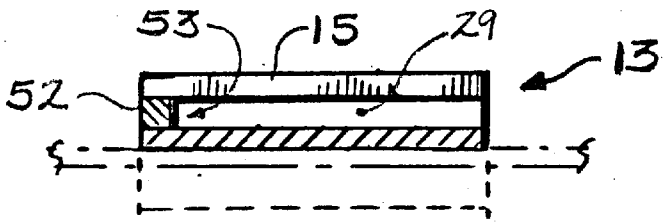
FIG. 5 is a cross-sectional view of the stock assembly mount taken along lines V—V in FIG. 2 illustrating a different view of the stock assembly mount affixed to the anchor fluke.
Figure 2:
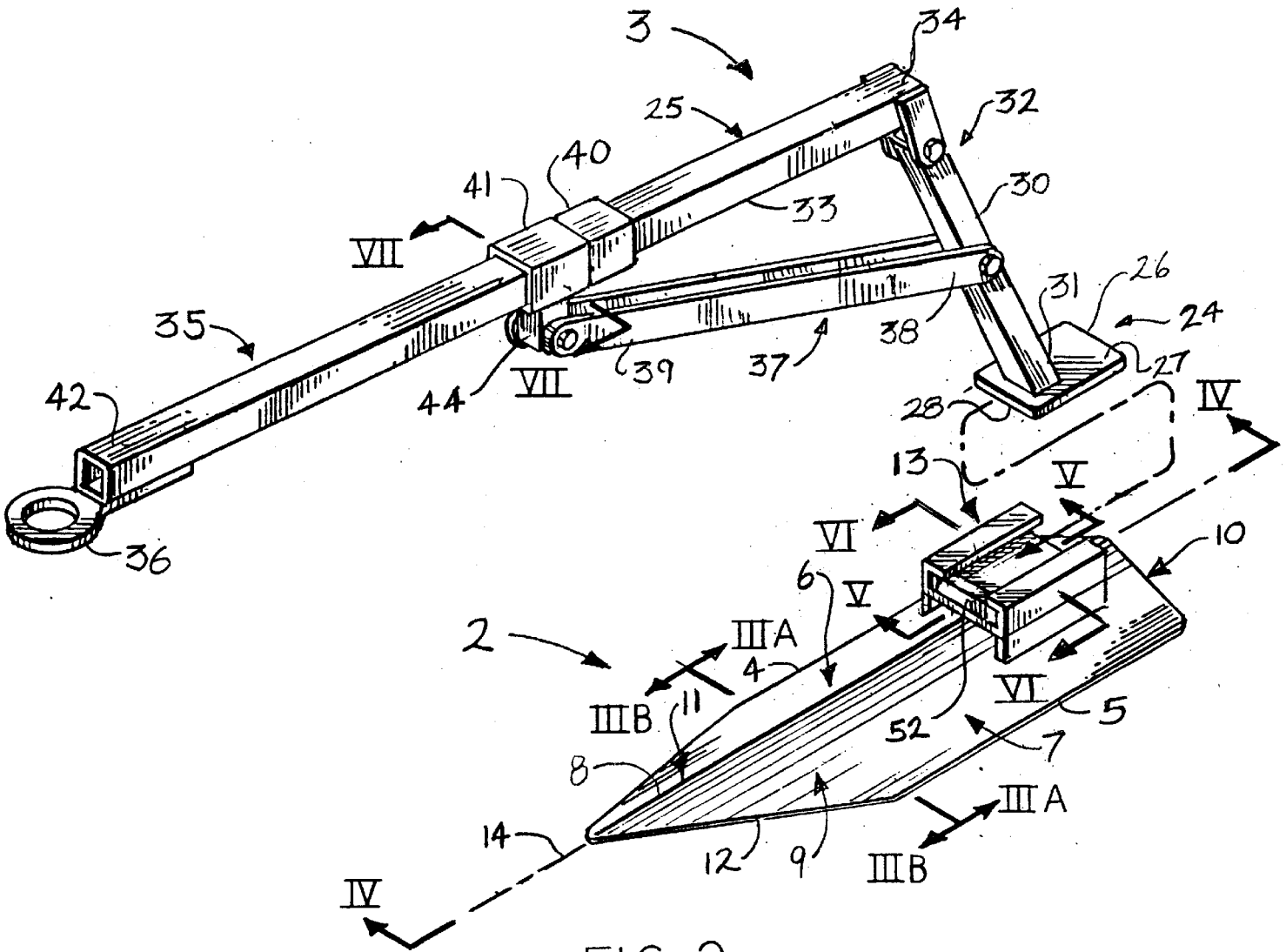
FIG. 2 is an exploded view of the preferred embodiment of the land anchor illustrated in FIG. 1.

With specific reference to FIGS. 1 and 2, land anchor 1 comprises two basic elements. The first element is the anchor fluke 2 that is also known in the industry as the anchor tine. The primary function of fluke 2 is to form a stationary unit to which a winch cable 47 can be attached to winch vehicle 48 toward the stationary unit. The second element is anchor stock assembly 3 constructed to be mounted on fluke 2 to form the land anchor. The primary functions of anchor stock, assembly 3 is to serve at a means to attach winch cable 47 and as a means to set the direction of the pulling force created by the winching operation.

Figure 4:
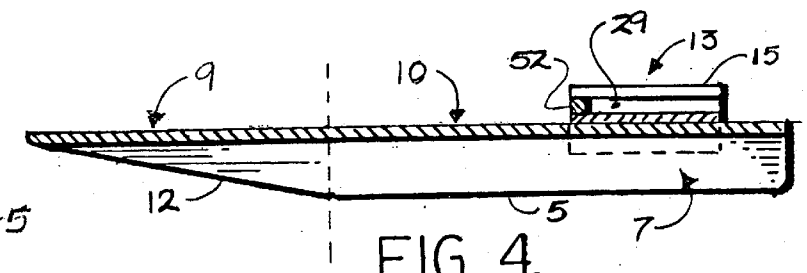
FIG. 4 is a cross-sectional view of the anchor fluke taken along lines IV—IV in FIG. 2 illustrating the stock assembly mount affixed to the anchor fluke.
Figure 6:
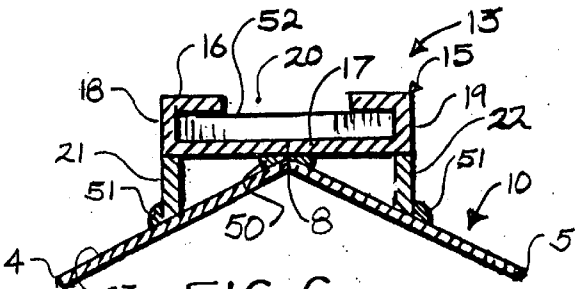
FIG. 6 is a cross-sectional view of the stock assembly mount taken along lines VI—VI in FIG. 2 illustrating another view of the stock assembly mount affixed to the anchor fluke.
Figure 3A:
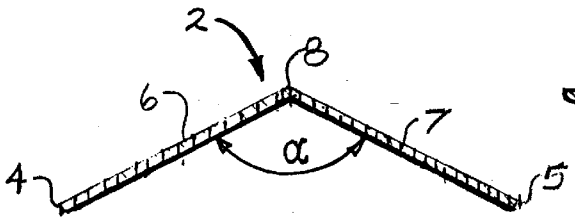
FIG. 3A is a cross-sectional view of the anchor fluke taken along lines IIIA—IIIA in FIG. 2 illustrating a preferred configuration of the fluke wings.
Figure 3B:
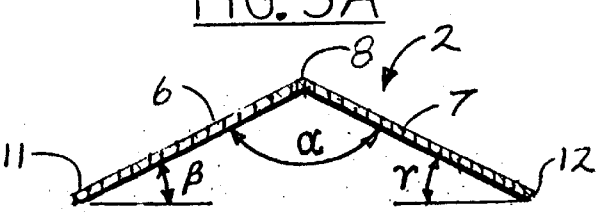
FIG. 3B is a cross-sectional view of the anchor fluke taken along lines IIIB—IIIB in FIG. 2 illustrating a preferred configuration of the fluke wings.

One of the novel features of the land anchor is the structure of fluke 2. Referring to FIGS. 2–4, fluke 2 is shaped not only to enable penetrate into the ground, but also to maintain the corresponding sections fluke outer edges 4 and 5 level with one another during the penetration. This feature enables fluke 2 to be more easily driven into the ground by the winch during the winching operation. It also facilitates the removable of fluke 2 from the ground once vehicle 48 has been pulled to the desired area where it can gain sufficient traction. As best seen in FIGS. 3A and 3B, in a particularly preferred embodiment these advantages are obtained by fluke 2 having a V-shaped cross-section formed by wing members 6 and 7. The wing members join to form ridgeline 8 and extend downward to form an angle $\alpha$ between 150° and 160°, more preferably about 155°. It has been found that best penetration, anchoring, and anchor removal are achieved when the wing members 6 and 7 are shaped to have a forward ground penetrating end section 9 that has a length along ridge 8 equal to 40%–60% of the length of a rear thrust end section 10. In a most preferred embodiment the forward ground penetrating end section 9 will have a length of about eight inches along ridge 8 and rear thrust end section 10 will have a length of about ten inches along ridge 8. Also in the most preferred embodiment the angle $\beta$ and $\gamma$ defined by ridge 8 and the forward outer edges 11 and 12, respectively, of wing members 6 and 7 are between 25° and 45°.

A second novel feature of the invention is the stock assembly mount 13. Referring to FIGS. 2 and 4–6, mount 13 is constructed to permit stock assembly 3 to be quickly and easily attached for use during the winching operation or removed for storage. Additionally mount 13 is constructed to withstand the tremendous forces that are exerted on mount 13 during the winching operation. Mount 13 is also preferably constructed to position stock assembly 3 for effective ground penetration, anchoring and anchor removal. Preferably mount 13 is formed from tubular member 15, preferably rectangular in cross-section. Tubular member 15 is affixed to fluke 2 by welds 50 or other known means, preferably along ridge 8 and on the rear thrust end section 10. Tubular member 15 is constructed having parallel top and bottom walls 16 and 17, respectively, separated by parallel side walls 18 and 19. A stop plate 52 is affixed to side walls 18 and 19 to obstruct at least a portion of the forward end 53 of passageway 29. The obstructed passageway will be used to receive stock assembly 3. Top wall 16 is provided with a slot 20 that extends the length of top wall 16. Tubular member 15 is affixed to rear thrust end section 10 to position slot 20 parallel to ridge 8. Tubular member 15 is provided with two leg members 21 and 22 that extend substantially perpendicularly downward from bottom wall 17 to the top surface 23 of fluke 2 where they can be affixed on opposite sides of ridge 8 by welds 51 or other known means. The horizontal length of each leg member 21 and 22 is preferably substantially equal to the length of tubular member 15. This mounting structure provides the strong stable mount preferred for operation of land anchor 1.

Another novel feature is the construction of the stock assembly 3. Referring now to FIG. 2, a preferred embodiment stock assembly 3 comprises an engaging member 24 and a stock 25. The engaging member 24 is shaped to engage and fit stock assembly 3 to stock assembly mount 13. This is done in a manner that retains engaging member 24 in stock assembly mount 13 during use, but permits engaging member 24 to be easily disengaged from stock assembly mount 13 for storage when land anchor 1 is not in use. More particularly, engaging member 24 is a plate 26 having substantially parallel top and bottom surfaces 27 and 28, respectively, which fits in passageway 29.

Figure 8:
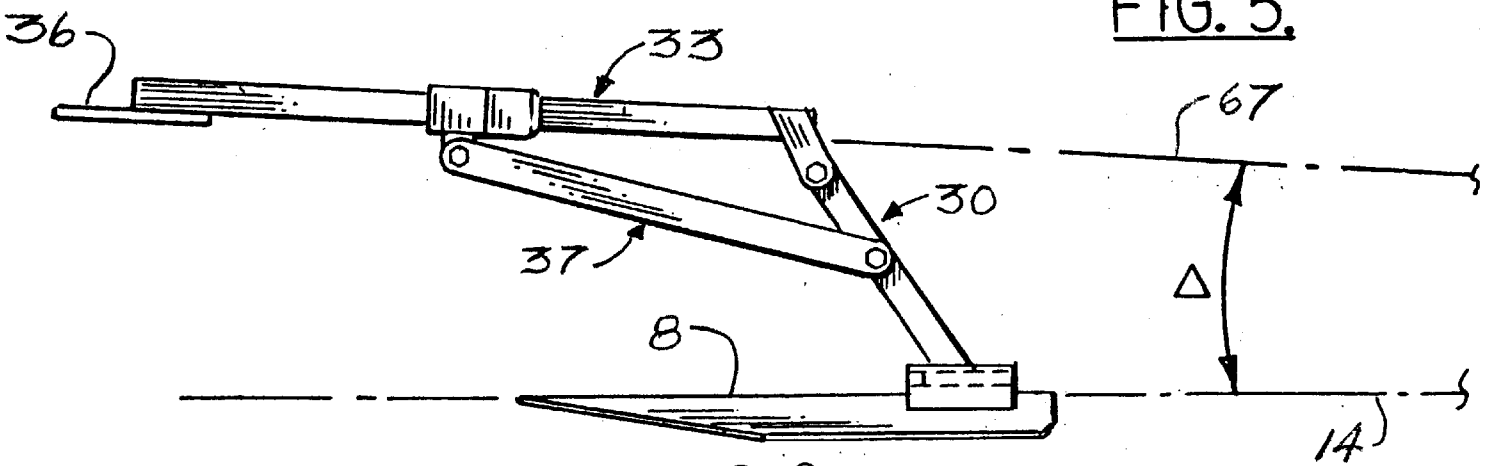
FIG. 8 is an illustrative representation of angle $\alpha$ formed by the tubular member axis and fluke ridge axis.
Figure 9:
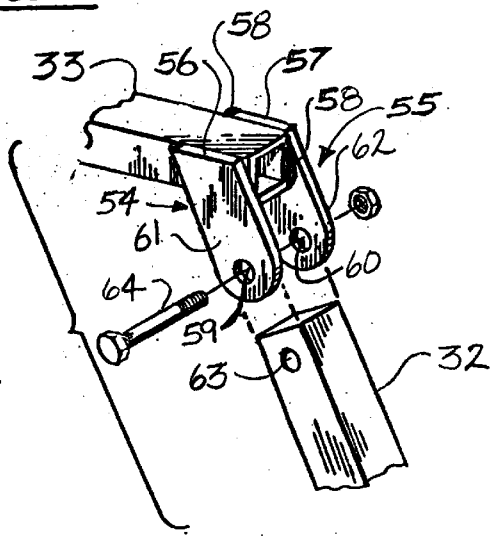
FIG. 9 is a perspective view of a preferred embodiment of the pivoting connection used to join the tubular member and bar of the land anchor stock.
Figure 7:
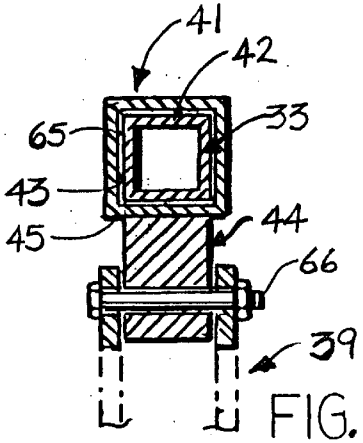
FIG. 7 is a cross-sectional view of the extension means collar positioned on the tubular member of the land anchor taken along lines VII—VII of FIG. 2.

In a preferred embodiment stock 25 comprises an elongated bar 30 fixed at one end 31 to engaging member 24 and with its opposite end 32 extending upward from top surface 27 at a predetermined fixed angle. In this embodiment stock 25 also comprises an elongated tubular member 33 having one end 34 pivotally affixed to the bar opposite end 32. In FIG. 9 a more preferred construction is illustrated of this pivoting connection. The connection is achieved by parallel metal strips 54 and 55 each affixed at one end 56 and 57, respectively, to tubular member 33 by welds 58, and each having aligned bolt openings 59 and 60, respectively, at their opposite ends 61 and 62, respectively. Bar opposite end 32 is also provided with a bolt opening 63 that is aligned with bolt openings 59 and 60 when metal strips 54 and 55 are positioned on opposite sides of bar 30. Bolt 64 is then passed through each of openings 59, 60, and 63 and secured in a manner to permit bar 30 and metal strips 54 and 55 to pivot relative to one another about bolt 64. The opposite end 35 of tubular member 33 in a more preferred embodiment is provided with shackle 36 to which winch cable 47 can be attached. In this embodiment stock 25 also comprises an extension means 37 affixed at one end 38 to bar 30 and pivotally affixed at its opposite end 39 to tubular member 33 in a construction to permit bar 30 and tubular member 33 to fold toward one another. A construction similar to that used to pivotally attach bar 30 to tubular member 37 may be used. In a more preferred embodiment tubular member 33 is provided with a stop 40 positioned between the opposite ends 34 and 35 of tubular member 33. In this embodiment stop 40 is a raised shoulder that extends around the circumference of tubular member 33. Stop 40 could also include one or more raised dimples or any other type construction that will prevent the passage of an object sliding along the surface of tubular member 33. In this more preferred embodiment extension means 37 is provided with a collar 41 pivotally affixed at extension means opposite end 39. As illustrated in FIGS. 2 and 7 collar 41 is shaped to slide along the surface 42 of tubular member 33 located between stop 40 and bar opposite end 32. In this embodiment the gap 65 between surface 42 and the interior wall surfaces 43 of collar 41 is less than the height of stop 40. To facilitate connection of collar 41 to extension means 37, an attaching bar 44 extends outward from collar exterior wall surface 45 at a position to be pivotally attached to extension means opposite end 39 by bolt 66 in a similar as the pivoting connection of bar 30 and tubular member 33. This embodiment also eliminates any possibility that the movement of extension means 37 would be impeded by stop 40. In a still more preferred embodiment stop 40 is positioned on tubular member 33 to set the angle Δ between 5° and 15°. As illustrated in FIG. 8 angle Δ is the angle formed by tubular member 33 and the fluke apex axis 14. Apex axis 14 extends along the upper ridge line 8 formed by fluke wing members 6 and 7. It has been found use of angle Δ results in a more consistent and efficient anchoring of fluke 2 in the ground when the winch cable is retracted.

In operation the winch cable 47 is uncoiled to extend to the area of ground 68 that it is desired to pull vehicle 48. With fluke ground penetrating end section 9 directed toward vehicle 48, fluke 2 is then pushed or driven into the ground 68 a couple of inches. Unless the soil is very compact and hard this can be achieved by hand and does not require the use of a sledgehammer to drive fluke 2 into the ground. Stock assembly 3 is then affixed to stock assembly mount 13 by inserting engaging member 24 into mount passageway 29 with shackle 36 facing toward vehicle 48. Extension means 37 is then adjusted to position collar 41 adjacent stop 40. Winch cable 47 is provided with hook 69 or other clasping means at its uncoiled end 70 that is attached to shackle 36. Winch 49 is then activated to re-coil cable 47 about winch drum 71. As the cable 47 is recoiled fluke ground penetrating end section 9 is forced further into ground 68 until the resistance of further penetration is greater than the force necessary to move vehicle 48. At this point vehicle 48 will then be moved toward land anchor 1. This movement is continued until vehicle 48 is on the desired ground location. Once vehicle 48 has been repositioned winch cable 47 is uncoiled sufficient to permit cable hook 69 to be disengaged from shackle 36. Winch cable 47 is then recoiled. To remove fluke 2 from ground area 68 one pulls up on tubular member 33 preferably at its opposite end 39. In the event that fluke 2 has been driven too deep in the ground to be removed by hand, one can now use the winch to pull fluke 2 from the ground. This can be accomplished by moving vehicle 48 back from fluke 2 and positioned on the opposite side of ground penetrating end section 9. Cable hook 69 is reattached to shackle 36 and winch cable 47 is then recoiled until fluke 2 is pulled up from the ground. Once land anchor 1 has been freed from the ground, fluke 2 and stock assembly 3 can be disengaged by removing engaging member 24 from assembly mount passageway 29. The two pieces can then be stored in a more compact fashion. It is obvious that several of the steps described above can be reversed in order without effecting the operation of land anchor 1 to pull vehicle 48 to a desired location.

There are of course other alternate embodiments that are obvious from the foregoing descriptions of the invention that are intended to be included within the scope of the invention as defined by the following claims.

We claim:

1. A land anchor for use with a winch and cable assembly affixed to a vehicle to pull the vehicle when immobilized comprising:

(a) a fluke having (i) a substantially V-shaped cross-section formed by wings having a ground penetrating end section shaped to penetrate into ground and a rear thrust end section and shaped to keep said fluke level during penetration into the ground, and (ii) having a stock assembly mount comprising a tubular member having upper, lower and side wall sections forming a cavity extending the length of the tubular member, the lower wall section affixed to the rear thrust end section, the upper wall section having a slot of predetermined width extending from one end of the upper wall section the tubular member toward its opposite end, and (b) a removable stock assembly comprising an engaging member forming a plate affixed perpendicularly to one end of a stock and having a width greater than the end of the stock and greater than the width of the slot, the engaging member and the stock sized to permit the engaging member to extend into the cavity of the tubular member affixable to said fluke.

2. A land anchor according to claim 1 wherein said fluke has a V-shaped cross-section formed by said wings that are separated from each other by an angle between 150° and 160°, each of said wines having one pointed end aligned with the pointed end of the other wing to form said ground penetrating end section and said rear thrust end section.

3. A land anchor according to claim 2 wherein said angle is about 155°.

4. A land anchor according to claim 2 wherein said forward ground penetrating end section has a length 40%–60% of the length of said rear thrust end section.

5. A land anchor according to claim 4 wherein said stock assembly further comprises a shackle affixed to one end of said stock assembly, said shackle shaped to receive and have attached a cable from the winch and cable assembly.

6. A land anchor according to claim 1 wherein said fluke further comprises a stock assembly mount for receiving and positioning said stock assembly above said fluke and in a position for causing said fluke to penetrate the ground when winched by said winch and cable assembly.

7. A land anchor according to claim 6 wherein said stock assembly mount comprises said tubular member having a parallel slot extending through one side of said tubular member, said tubular member being fixedly attached to said rear thrust end section with said slot being positioned to permit said stock assembly to be received by said stock assembly mount.

8. A land anchor according to claim 7 wherein:

(a) said tubular member has a rectangular cross-section formed by parallel top and bottom walls separated by parallel side walls, said tubular member having a longitudinal center axis vertically aligned with and extending parallel to an apex axis formed by said wings, and (b) said slot is formed in said top wall of said tubular member and is vertically aligned with and extends parallel to said apex axis.

9. A land anchor according claim 8 wherein said tubular member has two leg members extending downward from said bottom wall affixed to said fluke by welding one of said leg members to each of said wings.

10. A land anchor according to claim 9 wherein each of said leg members are affixed substantially perpendicularly to said bottom wall and have a length extending substantially along the length of said bottom wall and substantially equal distant to said apex axis.

11. A land anchor according to claim 1 wherein said stock assembly comprises:

(a) a engaging member having top and bottom surfaces, said engaging member shaped to engage and fix said stock assembly to a stock assembly mount, (b) a stock comprising:

(i) an elongated bar fixed at one end to said engaging member and with its opposite end extending upward at an angle from said top surface, (ii) an elongated tubular member having a bar attaching end and a cable attaching end, said bar attaching end pivotally affixed to said opposite end of said bar, and (iii) an extension means pivotally affixed at one end to said bar and pivotally affixed at its opposite end to said tubular member in a manner to permit said bar and said tubular member to fold toward one another.

12. A land anchor according to claim 11 wherein:

(a) said elongated tubular member comprises a stop positioned between said bar attaching end and said cable attaching end, and (b) said extension means comprises an elongated member having a collar affixed at its said opposite end, said collar shaped to slide along the length of said tubular member, said stop shaped to prevent said collar from sliding on the length said tubular member located between said stop and said bar attaching end.

13. A land anchor according to claim 12 wherein:

(a) said fluke having a V-shaped cross-section with an apex axis formed by said wings separated from each other by an angle between 150° and 160°, each of said wings having one pointed end aligned with the pointed end of the other wing to form said ground penetrating end section and said rear thrust end section, and (b) said stop is positioned to set the angle of the tubular member relative to said apex axis between 5° and 15°.

14. A land anchor according to claim 12 wherein:

(a) said fluke having a V-shaped cross-section with an apex axis formed by said wings separated from each other by an angle between 150° and 160°, each of said wings having one pointed end aligned with the pointed end of the other wing to form said ground penetrating end section and said rear thrust end section, (b) said stock assembly further comprising a shackle affixed at said cable attaching end, and (c) said collar being positioned between said shackle and said stop.

15. A land anchor according to claim 14 wherein said stop is positioned to set the angle of the tubular member relative to said apex axis between 5° and 15°.

16. A land anchor for use with a winch and cable assembly affixed to a vehicle to pull the vehicle when immobilized comprising:

(a) a fluke having wings shaped to penetrate into ground and shaped to keep said fluke level during penetration into the ground, said fluke has a V-shaped cross-section formed by said wings that are separated from each other by an angle between 150° and 160° so that outer edges of the fluke are maintained level with respect to each other during ground penetration, each of said wings having one pointed end aligned with the pointed end of the other wing to form a forward ground penetrating end section and a rear thrust end section, said fluke having a stock assembly mount for receiving and positioning said stock assembly above said fluke and in a position for causing said fluke to penetrate the ground when winched by said winch and cable assembly, and (b) a removable stock assembly affixable to said stock assembly mount.

17. A land anchor according to claim 16 said forward ground penetrating end section has a length 40%–60% of the length of said rear thrust end section.

18. A land anchor according to claim 17 wherein said stock assembly further comprises a shackle affixed to one end of said stock assembly, said shackle shaped to receive and have attached a cable from the winch and cable assembly.

19. A land anchor according to claim 17 wherein said stock assembly comprises:

(a) a engaging member having top and bottom surfaces, said engaging member shaped to engage and fix said stock assembly to said stock assembly mount, (b) a stock comprising:

(i) an elongated bar fixed at one end to said engaging member and with its opposite end extending upward at an angle from said top surface, (ii) an elongated tubular member having a bar attaching end and a cable attaching end, said bar attaching end pivotally affixed to said opposite end of said bar, and (iii) an extension means pivotally affixed at one end to said bar and pivotally affixed at its opposite end to said tubular member in a manner to permit said bar and said tubular member to fold toward one another.

20. A land anchor according to claim 19 further comprising a stop positioned to set the angle of the tubular member relative to said apex axis between 5° and 15°.

21. A land anchor according to claim 20 wherein:

(a) said stock assembly further comprising a shackle affixed at said cable attaching end, and (b) further comprising a collar positioned between said shackle and said stop.

22. A land anchor according to claim 21 wherein said stock assembly further comprises a shackle affixed to one end of said stock assembly, said shackle shaped to receive and have attached a cable form the winch and cable assembly.

23. A land anchor according to claim 16 wherein said stock assembly further comprises a shackle affixed to one end of said stock assembly, said shackle shaped to receive and have attached a cable from the winch and cable assembly.

24. A land anchor according to claim 16 wherein said stock assembly mount comprises a tubular member having a parallel slot extending through one side of said tubular member, said tubular member being fixedly attached to said rear thrust end section with said slot being positioned to permit said stock assembly to be received by said stock assembly mount.

25. A land anchor according to claim 24 wherein:

(a) said tubular member has a rectangular cross-section formed by parallel top and bottom walls separated by parallel side walls, said tubular member having a longitudinal center axis vertically aligned with and extending parallel to an apex axis formed by said wings, said tubular member having two leg members extending downward from said bottom wall affixed to said fluke by welding one of said leg members to each of said wings, and (b) said slot is formed in said top wall of said tubular member and is vertically aligned with and extends parallel to said apex axis.

26. A land anchor according to claim 25 wherein said stock assembly further comprises a shackle affixed to one end of said stock assembly, said shackle shaped to receive and have attached a cable from the winch and cable assembly.

27. A land anchor according to claim 25 said forward ground penetrating end section has a length 40%–60% of the length of said rear thrust end section.

28. A land anchor according to claim 27 wherein said stock assembly further comprises a shackle affixed to one end of said stock assembly, said shackle shaped to receive and have attached a cable from the winch and cable assembly.

29. A land anchor according to claim 16 wherein said stock assembly comprises:

(a) a engaging member having top and bottom surfaces, said engaging member shaped to engage and fix said stock assembly to said stock assembly mount, (b) a stock comprising:

(i) an elongated bar fixed at one end to said engaging member and with its opposite end extending upward at an angle from said top surface, (ii) an elongated tubular member having a bar attaching end and a cable attaching end, said bar attaching end pivotally affixed to said opposite end of said bar, and (iii) an extension means pivotally affixed at one end to said bar and pivotally affixed at its opposite end to said tubular member in a manner to permit said bar and said tubular member to fold toward one another.

30. A land anchor according to claim 29 wherein:

(a) said elongated tubular member comprises a stop positioned between said bar attaching end and said cable attaching end, and (b) said extension means comprises an elongated member having a collar affixed at its said opposite end, said collar shaped to slide along the length of said tubular member, said stop shaped to prevent said collar from sliding on the length said tubular member located between said stop and said bar attaching end.

31. A land anchor according to claim 30 wherein said stop is positioned to set the angle of the elongated tubular member relative to an apex axis of said fluke between 5° and 15°.

32. A land anchor according to claim 31 wherein said stock assembly further comprises a shackle affixed to one end of said stock assembly, said shackle shaped to receive and have attached a cable from the winch and cable assembly.

33. A land anchor according to claim 30 wherein:

(a) said stock assembly further comprises a shackle affixed at said cable attaching end, and (b) said collar being positioned between said shackle and said stop.

34. A land anchor according to claim 33 wherein said stock assembly further comprises a shackle affixed to one end of said stock assembly, said shackle shaped to receive and have attached a cable from the winch and cable assembly.

35. A land anchor for use with a winch and cable assembly affixed to a vehicle to pull the vehicle when immobilized comprising:

(A) a fluke having wings shaped to penetrate into ground, said fluke having a stock assembly mount for receiving and positioning said stock assembly above said fluke and in a position for causing said fluke to penetrate the ground when winched by said winch and cable assembly, said stock assembly mount comprising a tubular member having upper, lower and side wall sections forming a cavity extending the length of the tubular member, the lower wall section affixed to a rear thrust end section of said fluke the upper wall section having a slot of predetermined width extending from one end of the upper wall section of the tubular member toward its opposite end, and (B) a removable stock assembly affixable to said fluke, wherein said stock assembly comprises:

(i) a engaging member forming a plate affixed perpendicularly to one end of a stock and having a width greater than the end of the stock and greater than the width of the slot, the engaging member and the stock sized to permit the engaging member to extend into the cavity of the tubular member, the engaging member having top and bottom surfaces, said engaging member shaped to engage and fix said stock assembly to said stock assembly mount, (ii) said stock comprising:

(a) an elongated bar fixed at one end to said engaging member and with its opposite end extending upward at an angle from said top surface, (b) an elongated tubular member having a bar attaching end and a cable attaching end, said bar attaching end pivotally axed to said opposite end of said bar, and (c) an extension means pivotally affixed at one end to said bar and pivotally affixed at its opposite end to said tubular member in a manner to permit said bar and said tubular member to fold toward one another.

36. A land anchor according to claim 35 wherein:

(a) said tubular member has a rectangular cross-section formed by parallel top and bottom walls separated by parallel side walls, said tubular member having a longitudinal center axis vertically aligned with and extending parallel to an apex axis formed by said wings, said tubular member having two leg members extending downward from said bottom wall affixed to said fluke by welding one of said leg members to each of said wings, and (b) further comprising said slot formed in said top wall of said tubular member and is vertically aligned with and extends parallel to said apex axis.

37. A land anchor according to claim 36 further comprising a rear thrust end section and a forward ground penetrating end section having a length 40%–60% of the length of said rear thrust end section.

38. A land anchor according to claim 37 wherein said stock assembly further comprises a shackle affixed to one end of said stock assembly, said shackle shaped to receive and have attached a cable from the winch and cable assembly.

39. A land anchor according to claim 35 wherein:

(a) said fluke having a V-shaped cross-section with an apex axis formed by said wings separated from each other by an angle between 150° and 160°, each of said wings having one pointed end aligned with the pointed end of the other wing to form a forward ground penetrating end section and a rear trust end section, and (b) further comprising a stop positioned to set the angle of the elongated tubular member relative to said apex axis between 5° and 15°.

40. A land anchor according to claim 39 wherein:

(a) said tubular member has a rectangular cross-section formed by parallel top and bottom walls separated by parallel side walls, said tubular member having a longitudinal center axis vertically aligned with and extending parallel to said apex axis formed by said wings, said tubular member having two leg members extending downward from said bottom wall affixed to said fluke by welding one of said leg members to each of said wings, and (b) said land anchor further comprises said slot formed in said top wall of said tubular member and is vertically aligned with and extends parallel to said apex axis.

41. A land anchor according to claim 40 said forward ground penetrating end section has a length 40%–60% of the length of said rear thrust end section.

42. A land anchor according to claim 41 wherein said stock assembly further comprises a shackle affixed to one end of said stock assembly, said shackle shaped to receive and have attached a cable from the winch and cable assembly.

43. A land anchor according to claim 35 wherein:

(a) said fluke having a V-shaped cross-section with an apex axis formed by said wings separated from each other by an angle between 150° and 160°, each of said wings having one pointed end aligned with the pointed end of the other wing to form a forward ground penetrating end section and a rear trust end section, (b) said stock assembly further comprising a shackle affixed at said cable attaching end, and (c) said land anchor further comprising a collar being positioned between said shackle and a stop.

44. A land anchor/according to claim 43 wherein said stop is positioned to set the angle of the elongated tubular member relative to said apex axis between 5° and 15°.

45. A land anchor according to claim 44 said forward ground penetrating end section has a length 40%–60% of the length of said rear thrust end section.

46. A land anchor according to claim 45 wherein said a shackle is affixed to one end of said stock assembly, said shackle shaped to receive and have attached a cable from the winch and cable assembly.

47. A land anchor according to claim 43 wherein:

(a) said tubular member has a rectangular cross-section formed by parallel top and bottom walls separated by parallel side walls, said tubular member having a longitudinal center axis vertically aligned with and extending parallel to an apex axis formed by said wings, said tubular member having two leg members extending downward from said bottom wall affixed to said fluke by welding one of said leg members to each of said wings, and (b) said slot is formed in said top wall of said tubular member and is vertically aligned with and extends parallel to said apex axis.

48. A land anchor according to claim 47 where said shackle is shaped to receive and have attached a cable from the winch and cable assembly.

49. A land anchor for use with a winch and cable assembly affixed to a vehicle to pull the vehicle when immobilized comprising:

(A) a fluke having wings shaped to penetrate into ground, said fluke has a V-shaped cross-section formed by said wings that are separated from each other by an angle between 150° and 160° so that outer edges of the fluke are maintained level with respect to each other during ground penetration, each of said wings having one pointed end aligned with the pointed end of the other wing to form a forward ground penetrating end section and a rear thrust end section, said fluke having a stock assembly mount for receiving and positioning said stock assembly above said fluke and in a position for causing said fluke to penetrate the ground when winched by said winch and cable assembly, and (B) a removable stock assembly affixable to said fluke, wherein said stock assembly comprises:

(i) a engaging member having top and bottom surfaces, said engaging member shaped to engage and fix said stock assembly to said stock assembly mount, (ii) a stock comprising:

(a) an elongated bar fixed at one end to said engaging member and with its opposite end extending upward at an angle from said top surface, (b) an elongated tubular member having a bar attaching end and a cable attaching end, said bar attaching end pivotally affixed to said opposite end of said bar, and (c) an extension means pivotally affixed at one end to said bar and pivotally affixed at its opposite end to said tubular member in a manner to permit said bar and said tubular member to fold toward one another.

50. A land anchor according to claim 49 said forward ground penetrating end section has a length 40%–60% of the length of said rear thrust end section.

51. A land anchor according to claim 50 wherein said stock assembly further comprises a shackle affixed to one end of said stock assembly, said shackle shaped to receive and have attached a cable from the winch and cable assembly.

52. A land anchor according to claim 49 wherein:

(a) said stock assembly mount comprises a tubular member, said tubular member has a rectangular cross-section formed by parallel top and bottom walls separated by parallel side walls, said tubular member having a longitudinal center axis vertically aligned with and extending parallel to an apex axis formed by said wings, said tubular member having two leg members extending downward from said bottom wall affixed to said fluke by welding one of said leg members to each of said wings, and (b) said land anchor further comprises a slot formed in said top wall of said tubular member and is vertically aligned with and extending parallel to said apex axis.

53. A land anchor according to claim 52 said forward ground penetrating end section has a length 40%–60% of the length of said rear thrust end section.

54. A land anchor according to claim 53 wherein said stock assembly further comprises a shackle affixed to one end of said stock assembly, said shackle shaped to receive and have attached a cable from the winch and cable assembly.

55. A land anchor according to claim 52 wherein:

(a) said elongated tubular member comprises a stop positioned between said bar attaching end and said cable attaching end, and (b) said extension means comprises an elongated member having a collar affixed at its said opposite end, said collar shaped to slide along the length of said tubular member, said stop shaped to prevent said collar from sliding on the length said tubular member located between said stop and said bar attaching end.

56. A land anchor according to claim 55 wherein said stop is positioned to set the angle of the elongated tubular member relative to said apex axis between 5° and 15°.

57. A land anchor according to claim 56 said forward ground penetrating end section has a length 40%–60% of the length of said rear thrust end section.

58. A land anchor according to claim 57 wherein said stock assembly further comprises a shackle affixed to one end of said stock assembly, said shackle shaped to receive and have attached a cable from the winch and cable assembly.

59. A land anchor according to claim 56 wherein said stock assembly further comprises a shackle affixed to one end of said stock assembly, said shackle shaped to receive and have attached a cable from the winch and cable assembly.

60. A land anchor according to claim 55 wherein:

(a) said stock assembly further comprises a shackle affixed at said cable attaching end, and (b) said collar being positioned between said shackle and said stop.

61. A land anchor according to claim 60 said forward ground penetrating end section has a length 40%–60% of the length of said rear thrust end section.

62. A land anchor according to claim 61 wherein said stock assembly further comprises a shackle affixed to one end of said stock assembly, said shackle shaped to receive and have attached a cable from the winch and cable assembly.

63. A land anchor according to claim 60 wherein said stock assembly further comprises a shackle affixed to one end of said stock assembly, said shackle shaped to receive and have attached a cable from the winch and cable assembly.

64. A land anchor according to claim 49 wherein:

(a) said elongated tubular member comprises a stop positioned between said bar attaching end and said cable attaching end, and (b) said extension means comprises an elongated member having a collar affixed at its said opposite end, said collar shaped to slide along the length of said tubular member, said stop shaped to prevent said collar from sliding on the length said tubular member located between said stop said bar attaching end.

65. A land anchor according to claim 64 wherein said stop is positioned to set the angle of the tubular member relative to an apex axis of said fluke between 5° and 15°.

66. A land anchor according to claim 65 wherein:

(a) said stock assembly further comprising a shackle affixed at said cable attaching end, and (b) said collar being positioned between said shackle and said stop.

67. A land anchor according to claim 66 wherein said stock assembly further comprises a shackle affixed to one end of said stock assembly, said shackle shaped to receive and have attached a cable from the winch and cable assembly.

68. A land anchor according to claim 64 wherein:

(a) said stock assembly further comprises a shackle affixed at said cable attaching end, and (b) said collar being positioned between said shackle and said stop.

69. A land anchor according to claim 68 wherein said stock assembly further comprises a shackle affixed to one end of said stock assembly, said shackle shaped to receive and have attached a cable from the winch and cable assembly.

* * * * *